US012426682B2

(12) United States Patent
Campos, II et al.

(10) Patent No.: US 12,426,682 B2
(45) Date of Patent: Sep. 30, 2025

(54) SOLE STRUCTURE FOR ARTICLE OF FOOTWEAR

(71) Applicant: NIKE, Inc., Beaverton, OR (US)

(72) Inventors: Fidencio Campos, II, Dallas, OR (US); Wesley K. Chan, Portland, OR (US); Nate Durflinger, Beaverton, OR (US); Zachary M. Elder, Portland, OR (US); Jonathan Kosenick, Portland, OR (US); Lee D. Peyton, Tigard, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 4 days.

(21) Appl. No.: 18/189,513

(22) Filed: Mar. 24, 2023

(65) Prior Publication Data

US 2023/0225455 A1 Jul. 20, 2023

Related U.S. Application Data

(63) Continuation of application No. 16/950,792, filed on Nov. 17, 2020, now Pat. No. 11,638,463.
(Continued)

(51) Int. Cl.
*A43B 13/20* (2006.01)
*A43B 13/12* (2006.01)
*A43B 13/18* (2006.01)

(52) U.S. Cl.
CPC ..... *A43B 13/20* (2013.01); *A43B 13/125* (2013.01); *A43B 13/181* (2013.01); *A43B 13/186* (2013.01)

(58) Field of Classification Search
CPC ..... A43B 13/20; A43B 13/186; A43B 13/189; A43B 13/188; A43B 13/181; A43B 13/125
(Continued)

(56) References Cited

U.S. PATENT DOCUMENTS

D297,381 S 8/1988 Sugiyama
4,768,295 A 9/1988 Ito
(Continued)

FOREIGN PATENT DOCUMENTS

CN 101505625 A 8/2009
CN 104902773 A 9/2015
(Continued)

OTHER PUBLICATIONS

Patent Cooperation Treaty, International Search Report and Written Opinion of the International Searching Authority for PCT/US2020/061013, mailed Apr. 16, 2021.
(Continued)

*Primary Examiner* — Haley A Smith
(74) *Attorney, Agent, or Firm* — Honigman LLP; Matthew H. Szalach; Jonathan P. O'Brien

(57) ABSTRACT

A bladder for an article of footwear extends from an anterior end to a posterior end and includes a first chamber disposed in an interior region of the bladder and a second chamber at least partially surrounding the first chamber. The first chamber includes a first interior void having a first pressure and the second chamber includes a second interior void having a second pressure. In some implementations, the second chamber includes a plurality of lobes arranged in series and each having a first end, a second end, and an intermediate portion disposed between the first end and the second end. Each lobe has a greater thickness at the intermediate portion than at the first end and the second end, such that each lobe tapers from the intermediate portion to the first end and the second end.

19 Claims, 13 Drawing Sheets

Related U.S. Application Data

(60) Provisional application No. 62/937,462, filed on Nov. 19, 2019.

(58) Field of Classification Search
USPC ..... D2/961; 36/29
See application file for complete search history.

(56) References Cited

U.S. PATENT DOCUMENTS

| | | | | |
|---|---|---|---|---|
| D308,901 | S | 7/1990 | Hase | |
| 5,353,459 | A * | 10/1994 | Potter | A43B 17/03 36/71 |
| 5,575,088 | A | 11/1996 | Allen et al. | |
| 5,930,918 | A | 8/1999 | Healy et al. | |
| 6,253,466 | B1 | 7/2001 | Harmon-Weiss et al. | |
| 7,533,477 | B2 * | 5/2009 | Goodwin | A43B 3/0052 36/35 B |
| 7,707,745 | B2 * | 5/2010 | Schindler | A43B 7/144 36/35 B |
| 8,178,022 | B2 | 5/2012 | Schindler et al. | |
| 8,241,450 | B2 | 8/2012 | Hensley et al. | |
| 8,726,542 | B2 * | 5/2014 | Kim | A43B 13/187 36/103 |
| 8,863,408 | B2 | 10/2014 | Schindler et al. | |
| 9,179,733 | B2 * | 11/2015 | Peyton | A43B 13/189 |
| 9,609,912 | B2 * | 4/2017 | Holt | A43B 13/141 |
| 2003/0019128 | A1 | 1/2003 | Litchfield et al. | |
| 2004/0128860 | A1 * | 7/2004 | Smaldone | A43B 13/181 36/114 |
| 2005/0011085 | A1 | 1/2005 | Swigart et al. | |
| 2005/0028403 | A1 * | 2/2005 | Swigart | A43B 13/20 36/141 |
| 2005/0132607 | A1 * | 6/2005 | Dojan | A43B 21/28 36/28 |
| 2006/0248750 | A1 | 11/2006 | Rosenberg | |
| 2007/0074423 | A1 * | 4/2007 | Goodwin | A43B 3/0052 36/27 |
| 2007/0119075 | A1 | 5/2007 | Schindler et al. | |
| 2009/0152774 | A1 | 6/2009 | Hensley et al. | |
| 2013/0192087 | A1 * | 8/2013 | Litchfield | A43B 13/203 36/43 |
| 2013/0212909 | A1 | 8/2013 | Bates et al. | |
| 2013/0263391 | A1 | 10/2013 | Chao et al. | |
| 2014/0137437 | A1 | 5/2014 | Nakano | |
| 2014/0182167 | A1 | 7/2014 | James et al. | |
| 2016/0021974 | A1 | 1/2016 | Schindler et al. | |

FOREIGN PATENT DOCUMENTS

| | | | |
|---|---|---|---|
| CN | 205285212 | U | 6/2016 |
| CN | 108778028 | A | 11/2018 |
| KR | 101884754 | B1 | 8/2018 |

OTHER PUBLICATIONS

Patent Cooperation Treaty, International Preliminary Report on Patentability for PCT/US2020/061013, issued on May 17, 2022.
Taiwan Patent Office, First Office Action for 109140611 mailed Nov. 9, 2021.
USPTO, Non-Final Office Action for U.S. Appl. No. 16/950,792, mailed Aug. 19, 2022.
USPTO, Final Office Action for U.S. Appl. No. 16/950,792, mailed Apr. 12, 2022.
USPTO, Non-Final Office Action for U.S. Appl. No. 16/950,792, mailed Dec. 24, 2021.
China National Intellectual Property Office, Office Action for CN App. No. 202080092855.5, mailed Dec. 15, 2023.
European Patent Office, Communication pursuant to Article 94(3) EPC for EP App. No. 20828393.7, mailed Apr. 25, 2024.

* cited by examiner

SOLE STRUCTURE FOR ARTICLE OF FOOTWEAR

CROSS REFERENCE TO RELATED APPLICATION

This application is a continuation of U.S. application Ser. No. 16/950,792, filed Nov. 17, 2020, which claims priority to U.S. Provisional Application No. 62/937,462, filed Nov. 19, 2019, the contents of which are hereby incorporated by reference in their entirety.

FIELD

The present disclosure relates generally to sole structures for articles of footwear, and more particularly, to sole structures incorporating a bladder.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and may incorporate tensile members within the bladder to retain the shape of the bladder when pressurized. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
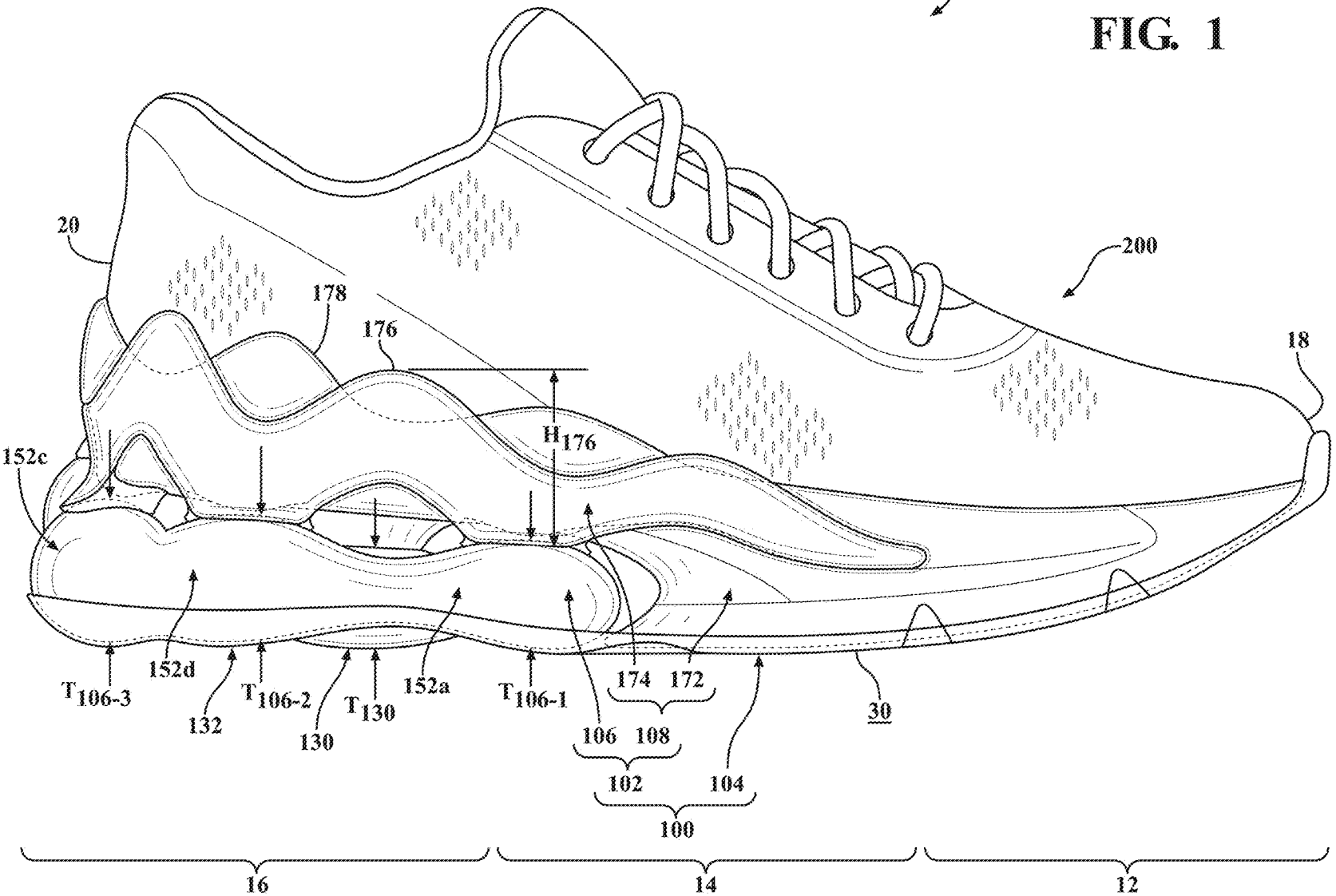
FIG. 1 is a side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present.

In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one aspect of the disclosure, a bladder for an article of footwear is provided. The bladder extends from an anterior end to a posterior end and includes a first chamber disposed in an interior region of the bladder and including a first interior void having a first pressure, and a second chamber at least partially surrounding the first chamber and including a second interior void having a second pressure.

Implementations of the disclosure may include one or more of the following optional features.

In some examples, the bladder has a first width adjacent to the anterior end of the bladder, a second width adjacent to the posterior end of the bladder, and a third width in an intermediate portion that is less than the first width and the second width.

In some configurations, the second chamber includes an anterior portion having a first cross-sectional area, a posterior portion having a second cross-sectional area, and an intermediate portion connecting the anterior portion and the posterior portion and having a third cross-sectional area. Here, the third cross-sectional area may be less than the first cross-sectional area. Optionally, the third cross-sectional area may be less than the second cross-sectional area. In some examples, the third cross-sectional area may be less than the first cross-sectional area and the second cross-sectional area.

In some implementations, the bladder includes a web area disposed between and connecting the first chamber and the second chamber.

In some examples, the bladder includes a first barrier layer and a second barrier layer joined together at discrete locations to define the first chamber and the second chamber. Optionally, at least one of the first barrier layer and the second barrier layer is transparent. In some examples, at least one of the first barrier layer and the second barrier layer is translucent.

In some configurations, the second chamber completely surrounds the first chamber.

In some examples, the second chamber partially surrounds the first chamber.

In some implementations, the second chamber includes a plurality of lobes, each lobe having a first end, a second end, and an intermediate portion disposed between the first end and the second end and being larger than the first end and the second end. Here, each lobe may taper from the intermediate portion to the first end and the second end. For each lobe, a thickness of the intermediate portion may be greater than thicknesses of the first end and the second end. Additionally or alternatively, for each lobe, a width of the intermediate portion is greater than widths of the first end and the second end. In some examples, a cross-sectional area of the intermediate portion is greater than the cross-sectional areas of the first end and the second end. Optionally, a plurality of the lobes are arranged in series around the first chamber.

In some examples, the plurality of lobes includes a medial anterior lobe and a lateral anterior lobe. Here, the medial anterior lobe and the lateral anterior lobe may be in direct fluid communication with each other.

In some implementations, the plurality of lobes includes a posterior lobe disposed at the posterior end of the bladder. Here, the posterior lobe may extend from a first end on a medial side of the bladder to a second end on a lateral side of the bladder. In some configurations plurality of lobes includes a lateral intermediate lobe and a medial intermediate lobe in direct fluid communication with the posterior lobe. Here, the lateral intermediate lobe and the medial intermediate lobe may be smaller than the posterior lobe. In some examples, a cross-sectional area of an interior void of the second chamber is greater at the intermediate portion of the posterior lobe than at the intermediate portions of each of the lateral intermediate lobe and the medial intermediate lobe. In some examples, a thickness of the intermediate portion of the posterior lobe defines a maximum thickness of the bladder.

In some implementations, the plurality of lobes includes a lateral intermediate lobe and a medial intermediate lobe disposed between the anterior end and the posterior end of the bladder.

In some examples, the first pressure is different than the second pressure. In some examples, the second pressure is greater than the first pressure. In some configurations, the first pressure ranges from 0 psi to 20 psi. In some implementations, the first pressure ranges from 5 psi to 15 psi. In some examples, the first pressure ranges from 7 psi to 10 psi. In some examples, the second pressure ranges from 0 psi to 35 psi. In some configurations, the second pressure ranges from 15 psi to 30 psi. In some implementations, the second pressure ranges from 20 psi to 25 psi. In some examples, the first pressure and the second pressure are atmospheric pressure.

In some configurations, a first thickness of the first chamber is greater than a second thickness of the second chamber at the anterior end and less than a third thickness of the second chamber at the posterior end.

Another aspect of the disclosure includes a sole structure including the bladder of any of the preceding clauses.

Another aspect of the disclosure is directed towards an article of footwear including the bladder described in the preceding paragraphs.

In another aspect of the disclosure, a sole structure is provided. The sole structure has a chassis including a bottom surface forming a first portion of the chassis and a recessed surface offset from the bottom surface to define a recess in a second portion of the chassis. The sole structure further includes a bladder disposed within the recess of the chassis and including a first chamber disposed in an interior region of the recess and a second chamber disposed in a peripheral region of the recess. The second chamber at least partially surrounds the first chamber and is fluidly isolated from the first chamber.

Implementations of the disclosure may include one or more of the following optional features.

In some examples, the second chamber completely surrounds the first chamber.

In some implementations, the second chamber partially surrounds the first chamber.

In some configurations, the first chamber has a different pressure than the second chamber.

In some examples, the chassis includes a cushioning element forming the bottom surface and the interior region of the recesses surface, and a cradle at least partially defining the peripheral region of the recessed surface, the cradle being formed of a different material than the cushioning element.

In some configurations, the recessed surface includes a plurality of supports each configured to interface with a respective lobe of the bladder. Here, a first one of the supports may be formed of a first material and a second one of the supports may be formed of a second material that is different than the first material. Optionally, the plurality of supports includes an interior support interfacing with the first chamber and a plurality of peripheral supports each interfacing with a respective lobe of the second chamber.

In some examples, the sole structure includes an outsole having a first portion attached to the chassis and a second portion attached to the bladder. Here, the second portion of the outsole optionally includes an interior portion attached to the first chamber and a peripheral portion attached to the second chamber and independently movable relative to the interior portion.

Figure 2:
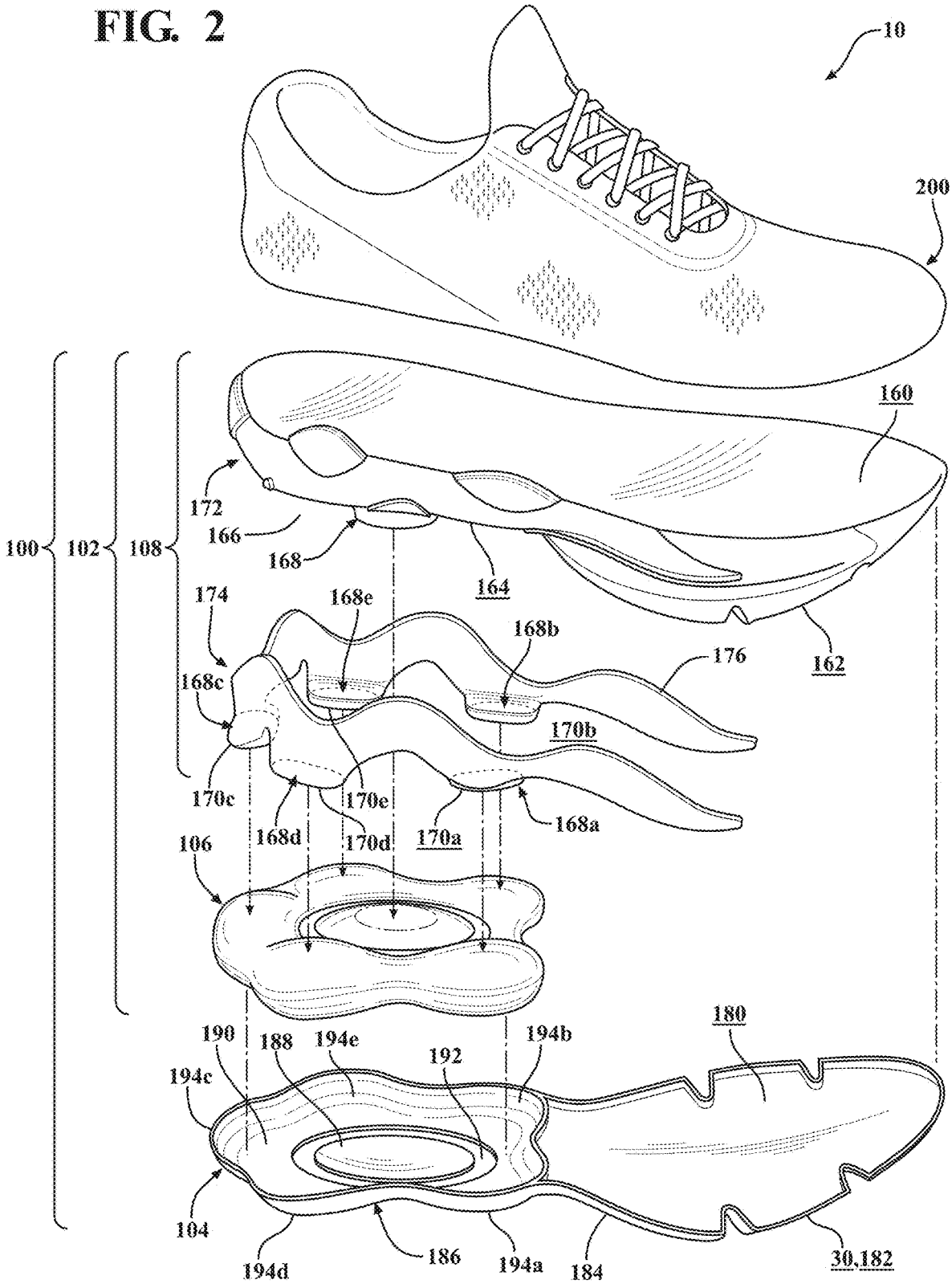
FIG. 2 is an exploded view of the article of footwear of FIG. 1, showing an article of footwear having an upper, a midsole, and an outsole arranged in a layered configuration.
Figure 3:
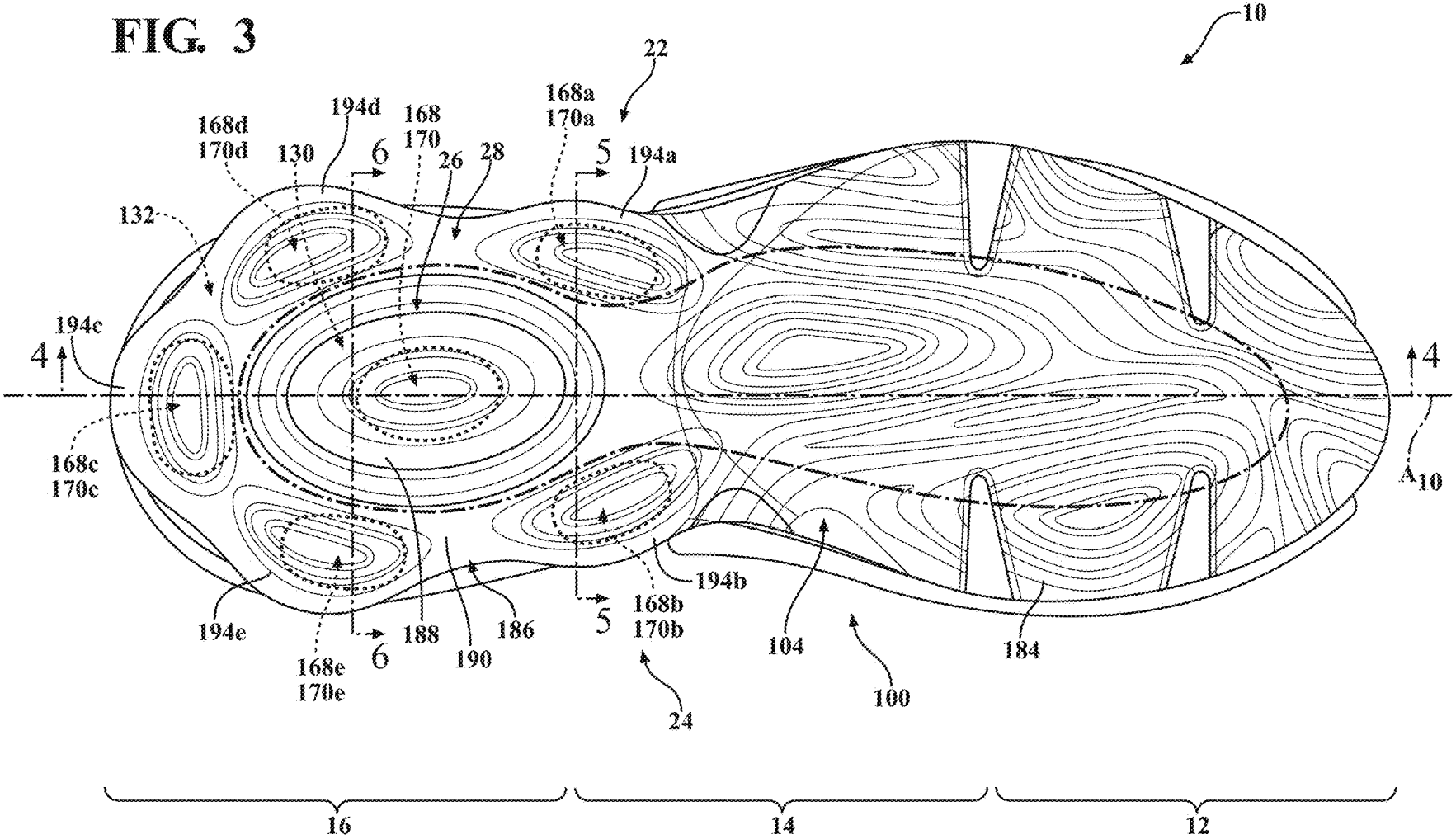
FIG. 3 is a bottom plan view of the article of footwear of FIG. 1.

Referring to FIGS. 1-6, an article of footwear 10 includes a sole structure 100 and an upper 200 attached to the sole structure 100. The article of footwear 10 may be divided into one or more regions. The regions may include a forefoot region 12, a mid-foot region 14, and a heel region 16. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a lateral side 22 and a medial side 24, as shown in FIG. 3. Accordingly, the lateral side 22 and the medial side 24 respectively correspond with opposite sides of the footwear 10 and extend through the regions 12, 14, 16.

The article of footwear 10, and more particularly, the sole structure 100, may be further described as including an interior region 26 and a peripheral region 28, as indicated in FIG. 3. The peripheral region 28 is generally described as being a region between the interior region 26 and an outer perimeter of the sole structure 100. Particularly, the peripheral region 28 extends from the forefoot region 12 to the heel region 16 along each of the lateral side 22 and the medial side 24, and wraps around each of the forefoot region 12 and the heel region 16. Thus, the interior region 26 is circumscribed by the peripheral region 28, and extends from the forefoot region 12 to the heel region 16 along a central portion of the sole structure 100.

With reference to FIG. 2, the sole structure 100 includes a midsole 102 configured to provide cushioning characteristics to the sole structure 100, and an outsole 104 configured to provide a ground-engaging surface 30 of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a bladder 106 and a chassis 108, where the chassis 108 is attached to the upper 200 and provides an interface between the upper 200, the bladder 106, and the outsole 104.

Figure 7B:
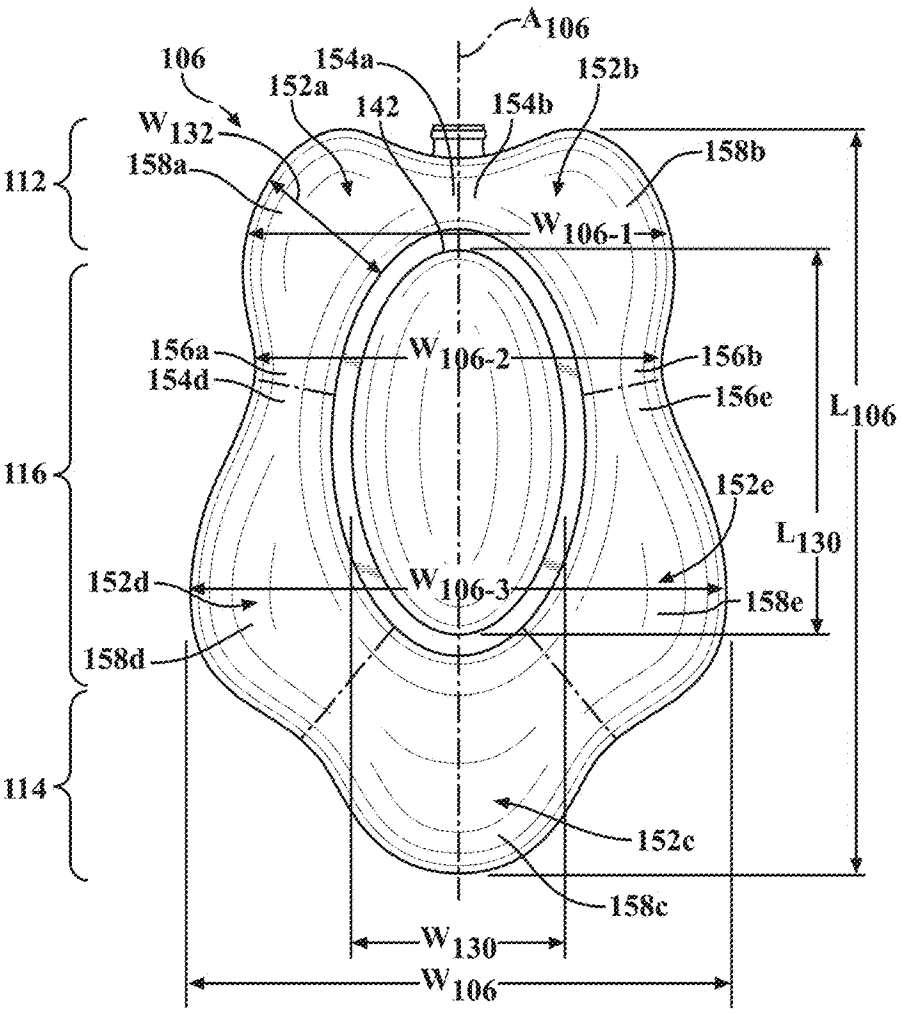
FIGS. 7A and 7B are bottom plan views of a bladder of the article of footwear of FIG. 1.
Figure 7A:
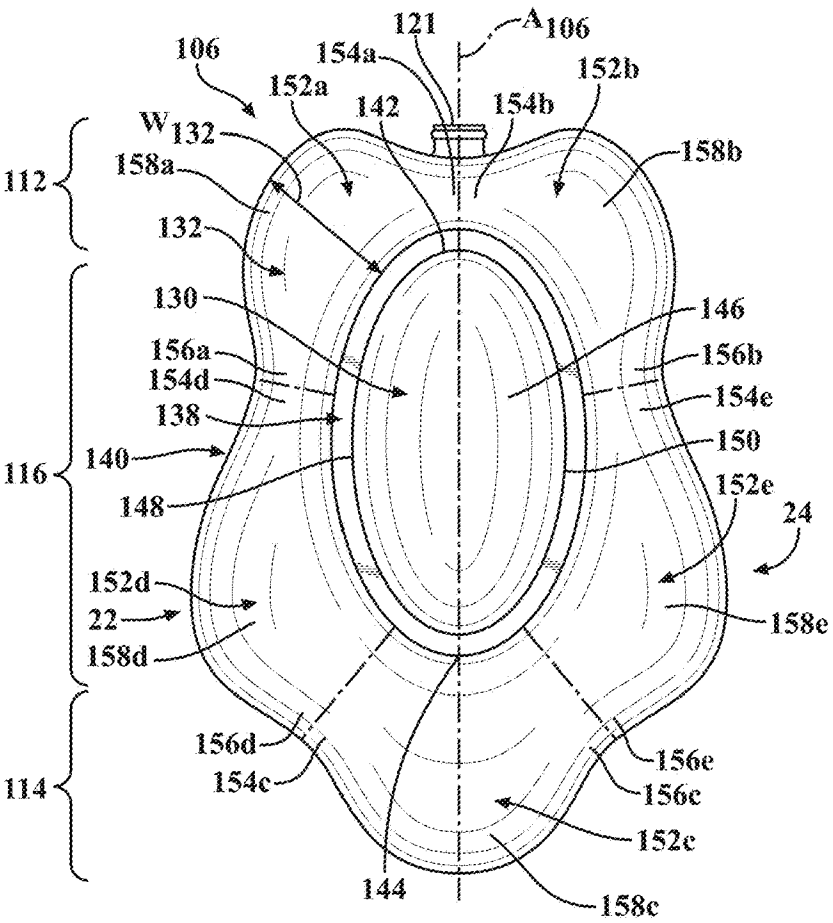
Figure 8:
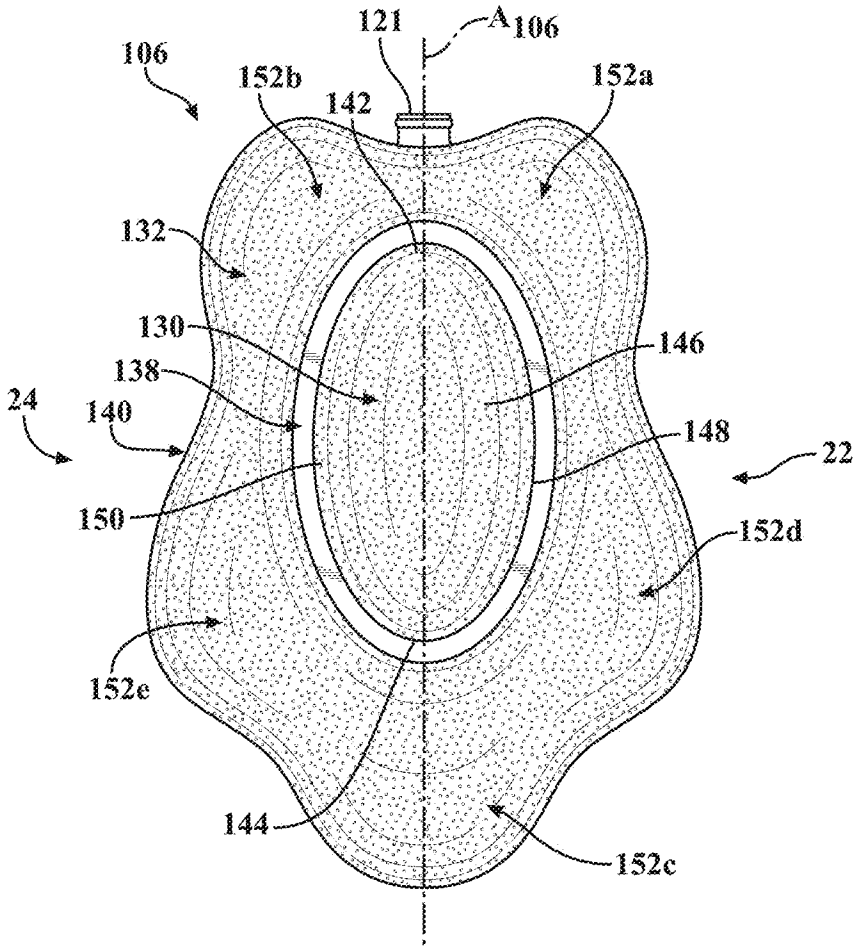
FIG. 8 is a top plan view of the bladder of the article of footwear of FIG. 1.

With reference to FIGS. 7 and 8, the bladder 106 of the midsole 102 may be described as extending along a longitudinal axis $A_{106}$ from a first, anterior end 112 to a second, posterior end 114 disposed at an opposite end of the bladder 106 than the anterior end 112. When incorporated into the article of footwear 10, the anterior end 112 of the bladder 106 is disposed within the heel region 16 or the midfoot region 14 and faces the anterior end 18 of the footwear 10, while the posterior end 114 is disposed at the posterior end 20 of the footwear 10. The bladder 106 may be further described as including an intermediate region 116 disposed between the anterior end 112 and the posterior end 114. The geometry and features of the bladder 106 may also be described relative to the peripheral region 28 and the interior region 26 of the article of footwear 10.

Figure 4:
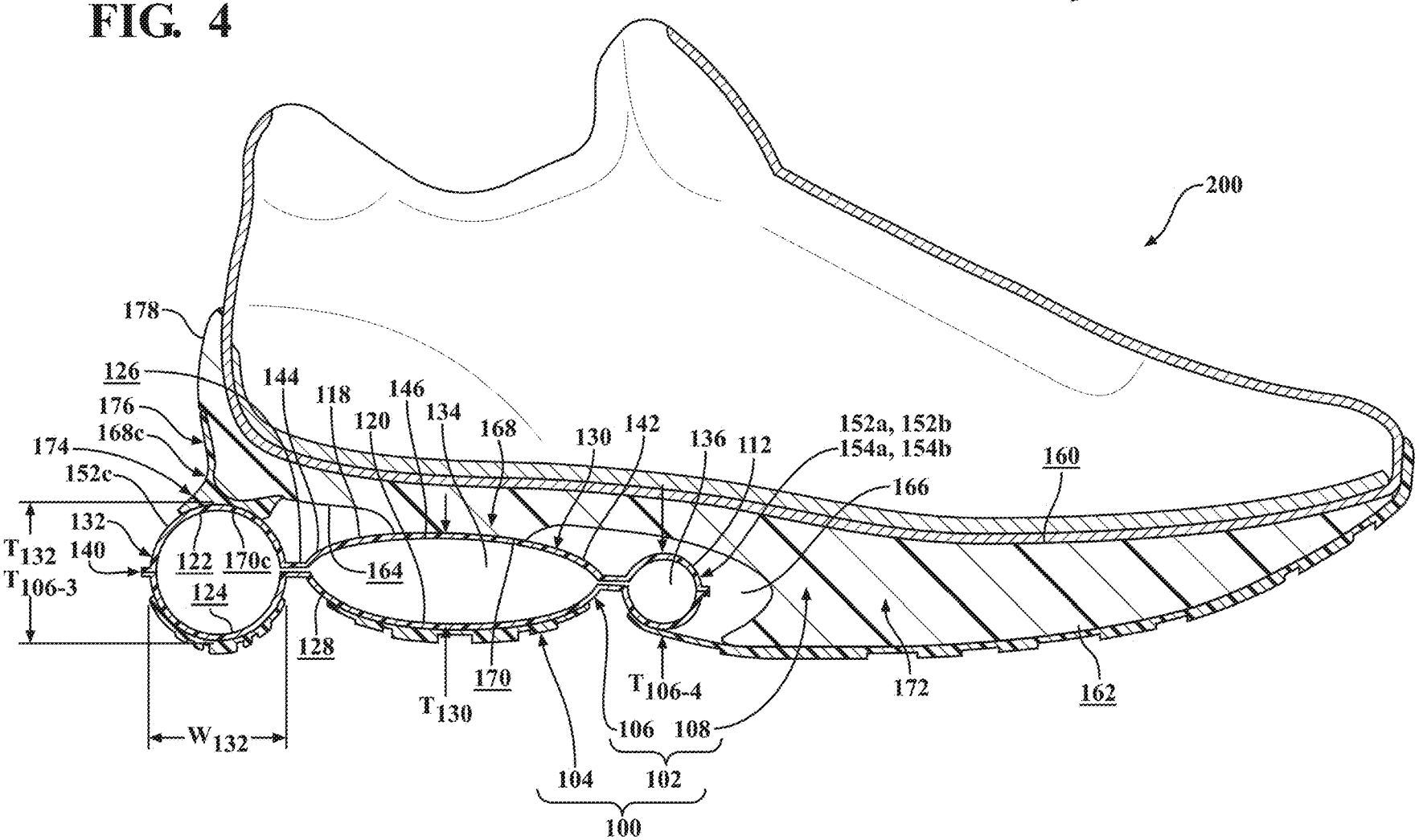
FIG. 4 is a cross-sectional view taken along line 4-4 of FIG. 3, showing a bladder disposed in a heel region and having a peripheral chamber and an interior chamber separated by a web area.
Figure 6:
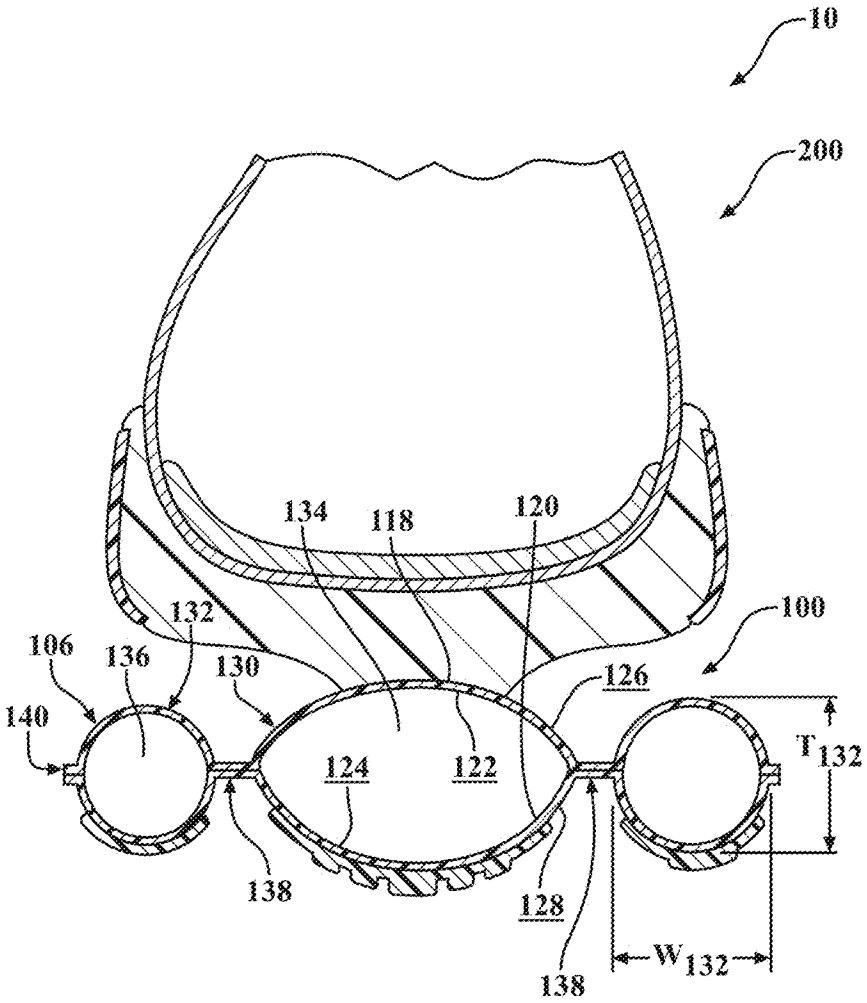
FIG. 6 is a cross-sectional view taken along line 6-6 of FIG. 3, showing a bladder having a peripheral chamber and an interior chamber separated by a web area.
Figure 5:
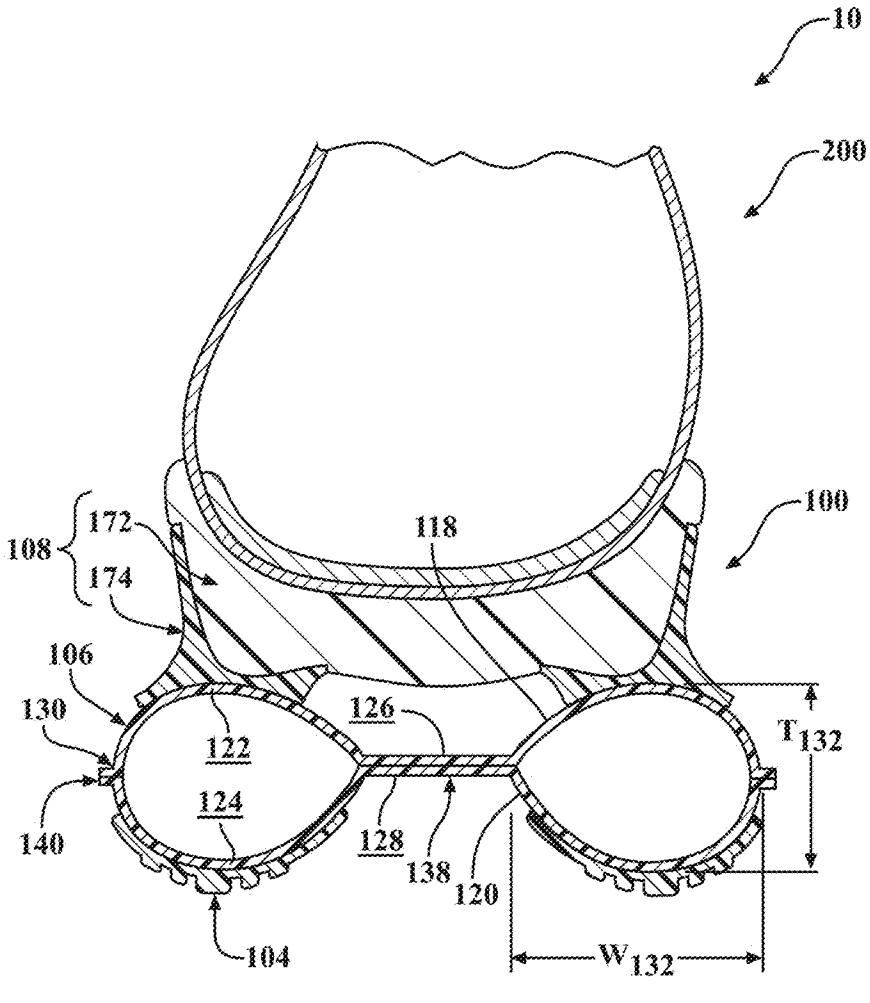
FIG. 5 is a cross-sectional view taken along line 5-5 of FIG. 3, showing segments of a peripheral chamber of a bladder disposed within a heel region of the sole structure and separated from one another by a web area.

As shown in the cross-sectional views of FIGS. 4-6, the bladder 106 may be formed by an opposing pair of barrier layers 118, 120, which can be joined to each other at discrete locations to define an overall shape of the bladder 106. Alternatively, the bladder 106 can be produced from any suitable combination of one or more barrier layers.

As used herein, the term "barrier layer" (e.g., barrier layers 118, 120) encompasses both monolayer and multilayer films. In some embodiments, one or both of the barrier layers 118, 120 are each produced (e.g., thermoformed or blow molded) from a monolayer film (a single layer). In other embodiments, one or both of the barrier layers 118, 120 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 118, 120 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 118, 120 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C=O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'- dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 118, 120 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 118, 120 include two or more sublayers, examples of suitable multilayer films include microlayer films, such as those disclosed in Bonk et al., U.S. Pat. No. 6,582,786, which is incorporated by reference in its entirety. In further embodiments, the barrier layers 118, 120 may each independently include alternating sublayers of one or more TPU copolymer materials and one or more EVOH copolymer materials, where the total number of sublayers in each of the barrier layers 118, 120 includes at least four (4) sublayers, at least ten (10) sublayers, at least twenty (20) sublayers, at least forty (40) sublayers, and/or at least sixty (60) sublayers.

The bladder 106 can be produced from the barrier layers 118, 120 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 118, 120 can be produced by co-extrusion followed by vacuum thermoforming to form the profile of the bladder 106, which can optionally include one or more valves 121 (e.g., one way valves) that allows the bladder 106 to be filled with the fluid (e.g., gas).

The bladder 106 desirably has a low gas transmission rate to preserve its retained gas pressure. In some embodiments, the bladder 106 has a gas transmission rate for nitrogen gas that is at least about ten (10) times lower than a nitrogen gas transmission rate for a butyl rubber layer of substantially the same dimensions. In an aspect, bladder 106 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 118, 120). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In the shown embodiment, the barrier layers 118, 120 include a first, upper barrier layer 118 and a second, lower barrier layer 120. Each of the barrier layers 118, 120 includes an interior surface 122, 124 and a respective exterior surface 126, 128 formed on an opposite side of the barrier layer 118, 120 from the interior surface 122, 124. The exterior surface 126 of the upper barrier layer 118 defines an upper surface of the bladder 106 and the exterior surface 128 of the lower barrier layer 120 defines a lower surface of the bladder 106. As discussed below, thicknesses of the bladder 106 are defined by distances from the exterior surface 126 of the upper barrier layer 118 to the exterior surface 128 of the lower barrier layer 120, measured along a vertical direction (i.e., perpendicular to the ground surface).

In the illustrated example, the interior surfaces 122, 124 of the barrier layers 118, 120 are joined together at discrete locations to define a plurality of chambers 130, 132. As shown in FIGS. 4-6, the interior surfaces 122, 124 of the upper and lower barrier layers 118, 120 are spaced apart from each other to define respective interior voids 134, 136 of each of the chambers 130, 132, while the interior surfaces 122, 124 are joined or attached to each other to form a web area 138 and a peripheral seam 140 surrounding each of the chambers 130, 132.

In the illustrated example, the bladder 106 includes a first, interior chamber 130 disposed in the interior region 26 of the bladder 106 and a second, peripheral chamber 132 surrounding the interior chamber 130. The web area 138 surrounds the interior chamber 130 and separates the interior chamber 130 from the peripheral chamber 132 such that the interior voids 134, 136 of the interior chamber 130 and the peripheral chamber 132 are isolated from each other (i.e., fluid or media cannot transfer between the interior voids 134, 136). The peripheral seam 140 extends around the outer periphery of the peripheral chamber 132 and defines an outer peripheral profile of the bladder 106.

As shown in FIGS. 7 and 8, the interior chamber 130 extends continuously along the longitudinal axis $A_{106}$ of the bladder from an anterior end 142 at the anterior end 112 of the bladder 106 to a posterior end 144 at the posterior end 114 of the bladder 106. When incorporated within the article of footwear 10, the interior chamber 130 is configured to support a central portion of the heel corresponding to the bottom of the calcaneus bone, while the peripheral chamber 132 provides a separate support structure that receives a portion of the heel therein.

A distance from the anterior end 142 to the posterior end 144 defines a length L130 of the interior chamber 130. The interior chamber 130 may be described as including an intermediate portion 146 disposed between the anterior end 142 and the posterior end 144. The interior chamber 130 may be further defined by a lateral side 148 and a medial side 150 each extending along opposite sides of the interior chamber 130 from the anterior end 142 to the posterior end 144, whereby a width $W_{130}$ of the interior chamber 130 is defined by a lateral distance (i.e., perpendicular to the longitudinal axis $A_{106}$) from the lateral side 148 to the medial side 150. As provided above, thicknesses $T_{130}$ (FIG. 4) of the interior chamber 130 are defined by the distance from the exterior surface 126 of the upper barrier layer 118 to the exterior surface 128 of the lower barrier layer 120 along the length $L_{130}$ and width $W_{130}$ of the interior chamber 130.

Referring to FIGS. 4, 7, and 8, the interior chamber 130 may be configured such that at least one of the width $W_{130}$ and the thickness $T_{130}$ tapers along a lengthwise direction of the longitudinal axis $A_{106}$ of the bladder 106. Particularly, the interior chamber 130 may have a greater width $W_{130}$ and/or thickness $T_{130}$ in the intermediate portion 146 than at one or both of the ends 142, 144. Accordingly, the cross-sectional area of the interior chamber 130 may also taper from the intermediate portion 146 to each of the ends 142, 144. In the illustrated example, the interior chamber 130 is formed as an ovoid, whereby the exterior surfaces 126, 128 of the upper barrier layer 118 and the lower barrier layer 120 are both convex in shape and each of the sides 148, 150 extends along an arcuate path. However, in other examples, either or both of the barrier layers 118, 120 may have other geometries, and at least a portion of the interior chamber 130 may have a constant cross-sectional area.

With continued reference to FIGS. 7 and 8, the peripheral chamber 132 extends along the peripheral region 28 from the anterior end 112 to the posterior end 114 of the bladder 106. As shown, the peripheral chamber 132 completely surrounds the interior chamber 130 such that the interior void 136 of the peripheral chamber 132 is interminable. As shown, an overall length $L_{106}$ and width $W_{106}$ of the bladder 106 are defined by the peripheral chamber 132, and more particularly, by the peripheral seam 140.

Referring now to FIGS. 4-6, the peripheral chamber 132 is formed with a variable cross-section, such that at least one of a width $W_{132}$ and a thickness $T_{132}$ of the peripheral chamber 132 changes along a length of the peripheral chamber 132. Here, the width $W_{132}$ of the peripheral chamber is defined as a distance across the peripheral chamber 132 from the web area 138 to the peripheral seam 140, while the thickness $T_{132}$ is defined by the distances between the exterior surfaces 126, 128 of the bladder 106.

Referring to FIGS. 7A and 7B, the peripheral chamber 132 may include a plurality of lobes 152*a*-152*e* each forming a portion of the peripheral chamber 132 having a variable cross-sectional area. For example, each of the lobes 152*a*-152*e* includes a first end 154*a*-154*e* having a first cross-sectional area, a second end 156*a*-156*e* having a second cross-sectional area, and an intermediate portion 158*a*-158*e* disposed between the first end 154*a*-154*e* and the second end 156*a*-156*e* and having a third cross-sectional area that is greater than the first cross-sectional area and the second cross-sectional area. Accordingly, each of the lobes 152*a*-152*e* tapers towards the respective first end 154*a*-154*e* and second end 156*a*-156*e* from the intermediate portion 158*a*-158*e*. In some examples, both the width $W_{132}$ and the thickness $T_{132}$ of each of the lobes 152*a*-152*e* tapers from the intermediate portion 158*a*-158*e*.

As shown in FIG. 7B, the variable cross section of the peripheral chamber 132 results in the overall width $W_{106}$ of the bladder 106 being variable from the anterior end 112 to the posterior end 114. Particularly, the bladder 106 has a first width $W_{106\text{-}1}$ across the intermediate portions 158*a*, 158*b* of the anterior lobes 152*a*, 152*b* adjacent to the anterior end 112, a second width $W_{106\text{-}2}$ across the second ends 156*a*, 156*b* of the anterior lobes 152*a*, 152*b* in the intermediate region 116, and a third width $W_{106\text{-}3}$ across the intermediate portions 158*d*, 158*e* of the intermediate lobes 152*d*, 152*e* adjacent to the posterior end 114. Here, the second width $W_{106\text{-}2}$ is less than the first width $W_{106\text{-}1}$ and the third width $W_{106\text{-}3}$, while the third width $W_{106\text{-}3}$ is greater than the first width $W_{106\text{-}1}$ and the second width $W_{106\text{-}2}$.

The illustrated example of the bladder 106 includes a plurality of the lobes 152*a*-152*e* arranged end-to-end in series around the interior chamber 130 such that the cross-sectional area of the peripheral chamber 132 alternates between larger and smaller sizes. As shown, the plurality of the lobes 152*a*-152*e* includes a first pair of anterior lobes 152*a*, 152*b* disposed at the anterior end 112 of the bladder 106, a posterior lobe 152*c* disposed at the posterior end 114 of the bladder 106, and a pair of intermediate lobes 152*d*, 152*e* disposed in the intermediate region 116 of the bladder 106.

The anterior lobes 152*a*, 152*b* of the peripheral chamber 132 include a lateral peripheral lobe 152*a* disposed at the anterior end 112 on the lateral side 22 of the bladder 106, and a medial peripheral lobe 152*b* disposed at the anterior end 112 on the medial side 24 of the bladder 106. As shown, the first ends 154*a*, 154*b* of the anterior lobes 152*a*, 152*b* are connected to each other at the longitudinal axis $A_{106}$ of the bladder 106. Each of the anterior lobes 152*a*, 152*b* extends from its respective first end 154*a*, 154*b* and around the anterior end 142 of the interior chamber 130 to its respective second end 156*a*, 156*b* in the intermediate region 116 of the bladder 106. In the illustrated example, the anterior lobes 152*a*, 152*b* provide the peripheral chamber 132 with an increased width $W_{132}$ at the lateral and medial sides of the anterior end 112 such that the anterior lobes 152*a*, 152*b* form a pair of forward-protruding portions at opposite sides of the anterior end 112 of the bladder 106.

With continued reference to FIGS. 7 and 8, the posterior lobe 152*c* is disposed at the posterior end 114 of the bladder 106 and the intermediate portion 158*c* of the posterior lobe 152*c* is centrally positioned along the longitudinal axis $A_{106}$ of the bladder 106. In the illustrated example, the posterior lobe 152*c* extends around the posterior end 144 of the interior chamber 130 from a first end 154*a* on the lateral side 22 of the bladder 106 to a second end 156*c* on the medial side 24 of the bladder 106. As discussed above, the intermediate portion 158*c* has a greater cross-sectional area than each of the ends 154*c*, 156*c*.

The intermediate lobes 152*d*, 152*e* of the peripheral chamber 132 include a lateral intermediate lobe 152d disposed in the intermediate region 116 on the lateral side 22 of the bladder 106, and a medial intermediate lobe 152*e* disposed in the intermediate region 116 on the medial side 24 of the bladder 106. As shown, first ends 154*d*, 154*e* of the intermediate lobes 152*d*, 152*e* are connected to the second ends 156*a*, 156*b* of the lateral and medial anterior lobes 152*a*, 152*b*, respectively. The second end 156*d* of the lateral intermediate lobe 152d is connected to the first end 154*c* of the posterior lobe 152*c* at the posterior end 114 of the bladder 106. Likewise, the second end 156*e* of the medial intermediate lobe 152*e* is connected to the second end 156*c* of the posterior lobe 152*c* at the posterior end 114 of the bladder 106. Similar to the anterior lobes 152*a*, 152*b* at the anterior end 112 and the posterior lobe 152*c* at the posterior end 114, the intermediate lobes 152*d*, 152*e* provide the peripheral chamber 132 with protruding portions along the lateral and medial sides 22, 24 of the intermediate region 116 of the bladder 106.

Referring now to FIG. 1, the thickness $T_{106}$ the bladder 106 generally increases along a direction from the anterior end 112 to the posterior end 114. However, as discussed above, because the peripheral chamber 132 is formed with a variable cross section, the change in thickness is not constant $T_{106}$ and continuous along the length of the bladder 106. Instead, the thickness of the bladder 106 incrementally increases along the length $L_{106}$ of the bladder 106. For example, the bladder 106 has a first thickness $T_{106\text{-}1}$ at the anterior end 112 defined by the intermediate portions 158*a*, 158*b* of the anterior lobes 152*a*, 152*b*, a second thickness $T_{106\text{-}2}$ in the intermediate region 116 defined by the intermediate portions 158*d*, 158*e* of the intermediate lobes 152*d*, 152*e*, and a third thickness $T_{106\text{-}3}$ at the posterior end 114 defined by the intermediate portion 158*c* of the posterior lobe 152*c*. Here, the second thickness $T_{106\text{-}2}$ is greater than the first thickness $T_{106\text{-}1}$ and less than the third thickness $T_{106\text{-}3}$, such that an average thickness of the bladder 106 increases from the anterior end 112 to the posterior end 114. Furthermore, as shown in the cross-sectional view of FIG. 4, the thickness of the bladder 106 also incrementally increases along the longitudinal axis $A_{106}$. Accordingly, the bladder 106 has a thickness $T_{106\text{-}4}$ at the first ends 154*a*, 154*b* of the anterior lobes 152*a*, 152*b* that is less than the thickness $T_{130}$ of the interior chamber 130, which is, in turn, less than the thickness $T_{106\text{-}3}$ at the posterior lobe 152*c*.

The chambers 130, 132 can be provided in a fluid-filled (e.g., as provided in footwear 10) or in an unfilled state. The chambers 130, 132 can be filled to include any suitable fluid, such as a gas or liquid. In an aspect, the gas can include air, nitrogen ($N_2$), or any other suitable gas. The fluid provided to the chambers 130, 132 can result in the bladder 106 being pressurized. Alternatively, the fluid provided to the chambers 130, 132 can be at atmospheric pressure such that the chambers 130, 132 are not pressurized but, rather, simply contains a volume of fluid at atmospheric pressure. In other aspects, the chambers 130, 132 can alternatively include other compressible media, such as pellets, beads, ground recycled material, and the like (e.g., foamed beads and/or rubber beads).

In the illustrated example, the interior void 134 of the interior chamber 130 includes a first fluid at a first pressure and the interior void 136 of the peripheral chamber 132 includes a second fluid at a second pressure. As discussed above, the interior chamber 130 is isolated from the peripheral chamber 132 such that the first pressure and the second pressure may be independently maintained within the interior voids 134, 136. The first pressure and the second pressure may be different from each other. For instance, the first pressure within the interior void 134 of the interior chamber 130 may be less than the second pressure within the interior void 136 of the peripheral chamber 132 when the bladder 106 is in an uncompressed (i.e., natural) state. In some examples, the first pressure ranges from 0 psi to 20 psi, and more particularly from 5 psi to 15 psi, and even more particularly from 7 psi to 10 psi. The second pressure may range from 0 psi to 35 psi, and more particularly from 15 psi to 30 psi, and even more particularly from 20 psi to 25 psi.

Providing the bladder 106 with an interior chamber 130 having a lower pressure than the surrounding peripheral chamber 132 allows the interior chamber 130 to provide a softer cushioning response to a point load applied by the central portion of the heel when sole structure 100 contacts a ground surface. Upon initial compression of the interior chamber 130, the higher pressure of the peripheral chamber 130 provides secondary cushioning around a perimeter of the heel. Furthermore, the higher pressure of the peripheral chamber 132 provides the heel region with enhanced lateral (i.e., side-to-side, front-to-back) stability. Thus, the dual-chamber configuration of the bladder 106 advantageously provides both impact attenuation and stability.

With continued reference to FIGS. 1-4, the chassis 108 of the sole structure 100 extends continuously from the anterior end 18 to the posterior end 20. The chassis 108 includes a top surface 160 defining a profile of a footbed of the article of footwear 10. The chassis 108 further includes a bottom surface 162 and a recessed surface 164 formed on an opposite side of the chassis 108 than the top surface 160. In the illustrated example, the bottom surface 162 extends from the anterior end 18 of the sole structure 100 and terminates at an intermediate portion of the chassis 108 in the midfoot region 14.

The recessed surface 164 is spaced between the top surface 160 and the bottom surface 162, and defines a recess 166 in the heel region 16 of the sole structure 100 that is configured to receive the bladder 106. Thus, a depth or height of the recess 166 is defined by the offset distance between the bottom surface 162 and the recessed surface 164. Here, the height of the recess 166 is configured such that when the bladder 106 is disposed within the recess 166, the lower surface 128 of the bladder 106 and the bottom surface 162 of the chassis 108 will cooperate to form a bottom support surface of the midsole 102 that attaches to the outsole 104.

As best shown in FIG. 4, the recessed surface 164 may include one or more supports 168 configured to interface with the bladder 106. Particularly, the one or more supports 168-168*e* are configured as protruding portions of the recessed surface 164 that oppose the upper barrier layer 118 of the bladder 106. Accordingly, compression forces applied to the top surface 160 of the chassis 108 in the heel region 16 are transferred to the bladder 108 as localized loads by the one or more supports 168-168*e*. Thus, the chassis 108 is not in continuous contact with the upper barrier layer 118, but instead contacts the upper barrier layer 118 at one or more discrete interfaces between a lower support surface 170 of each support 168-168*e* and the upper barrier layer 118. For example, the lower support surfaces 170-170*e* of the supports 168-168*e* may be configured to contact the uppermost portions of the upper barrier layer 118.

In the illustrated example, the one or more supports 168 includes an interior support 168-168*e* formed in the interior region 26 of the recessed surface 164 and configured to oppose the portion of the upper barrier layer 118 forming the interior chamber 130. The chassis 108 further includes a plurality of peripheral supports 168*a*-168*e* each configured to interface with a respective one of the lobes 152*a*-152*e* of the peripheral chamber 132. Thus, the chassis 108 is attached to the bladder 106 at the uppermost portions of the interior chamber 130 and each of the lobes 152*a*-152*e*, while lower portions of the upper barrier layer 118 (i.e., adjacent to and including the web area 138) are spaced apart and detached from the chassis 108.

Optionally, the chassis 108 may be formed as a unitary body or as a composite structure. For instance, in the illustrated example, the chassis 108 is formed as a composite, multi-part structure including a cushioning element 172 and a cradle 174. The cushioning element 172 is formed as a first part and extends from the anterior end 18 to the posterior end 20. The cushioning element 172 defines the top surface 160 and the bottom surface 162 of the chassis 108. The cushioning element 172 further defines a portion of the recessed surface 164 in the interior region 26 of the chassis 108 such that the interior support 168 is included in the cushioning element 172.

The cradle 174 may be formed as a second part and attached to the cushioning element 172. Here, the cradle 174 extends around the peripheral region 28 of the chassis 108 in the midfoot and heel regions 14, 16. A portion of the recessed surface 164 in the peripheral region 28 of the chassis 108 is defined by the cradle 174. Particularly, the cradle 174 may include one or more of the peripheral supports 168*a*-168*e*. In the illustrated example, the cradle 174 includes all of the peripheral supports 168*a*-168*e*. Accordingly, the interior support 168 is formed by the cushioning element 172 and the peripheral supports 168*a*-168*e* are formed by the cradle 174.

Referring to FIG. 1, the cradle 174 may further include a peripheral wall 176 that extends upwardly from the recessed surface and at least partially surrounds the upper 200 to provide lateral support around an outer periphery of the sole structure 100 and the upper 200. Optionally, the peripheral wall 176 may have an undulated profile, such that a height $H_{176}$ of the peripheral wall 176 varies along the outer periphery of the upper 200. In some examples, the peripheral wall 176 of the cradle 174 may cooperate with a peripheral wall 178 of the cushioning element 172 to provide lateral support around the upper 200.

In examples where the chassis 108 is formed as a composite structure including the cushioning element 172 and the cradle 174, the cushioning element 172 and the cradle 174 may be formed of materials having different properties. For example, the cushioning element 172 may include first materials configured to provide desired levels of cushioning and impact attenuation, while the cradle 174 is formed of one or more materials configured to impart a greater degree of stiffness to the heel region 16 of the chassis 108. In some examples, the cushioning element 172 may be formed in part of a first foam material and the cradle may be formed in part of a second foam material having a greater stiffness and/or density than the first foam material. As such, the interior support 168 that is formed by the cushioning element 172 may have different properties than the peripheral supports 168*a*-168*e* that are formed by the cradle 174. However, as provided above, the inclusion of the cradle 174 is optional, such that the entire chassis 108 may be formed as a unitary structure where all of the supports 168-168*e* are formed of the same material.

With continued reference to FIG. 2, the outsole 104 is configured to be attached to the midsole 102 to provide a durable ground-engaging surface 30 to the sole structure 100. The outsole 104 includes a top surface 180 that attaches to the bottom support surface 128, 162 of the midsole 102, and a bottom surface 182 formed on an opposite side of the outsole 104 than the top surface 180. The outsole 104 may be described as including a first portion 184 attached to the bottom surface 162 of the chassis 108 and a second portion 186 attached to the lower surface 128 of the bladder 106. As shown, the outsole 104 is formed as a unitary structure such that the first portion 184 and the second portion 186 are attached to each other and effectively connect the lower surface 128 of the bladder 106 and the bottom surface 162 of the chassis 108 along the bottom of the sole structure 100.

With continued reference to FIGS. 2 and 3, the second portion 186 of the outsole 104 may include an interior portion 188 associated with the interior chamber 130 and a peripheral portion 190 associated with the peripheral chamber 132. The interior portion 188 of the outsole 104 is attached to a portion of the lower barrier layer 120 forming the interior chamber 130 while the peripheral portion 190 is attached to a portion of the lower barrier layer 120 forming the peripheral chamber 132.

In some examples, the interior portion 188 and the peripheral portion 190 are formed separately from each other such that peripheral portion 190 can move completely independently from the interior portion 188. In this configuration, the interior portion 188 may be spaced apart and separated from the peripheral portion 190 such that the bladder 106 is exposed therebetween. Optionally, the second portion 186 of the outsole 104 may include a flexure 192 disposed between and connecting the interior portion 188 and the peripheral portion 190. The flexure 192 is configured to allow the peripheral portion 190 to move relatively independently from the interior portion 188. For example, the flexure 192 may be detached and spaced apart from the bladder 106, and/or may be formed with different properties (e.g., stiffness, thickness) than the interior and peripheral portions 188, 190 to allow relative movement thereof.

With continued reference to FIGS. 3-6, the outsole 104 may be overmolded on the lower barrier layer 120 of the bladder 106 to correspond to the features of the bladder 106. For example, the peripheral portion 190 of the outsole 104 may be formed with lobes 194*a*-194*e* corresponding to the lobes 152*a*-152*e* of the peripheral chamber 132, while the interior portion 188 of the outsole 104 conforms to the shape of the interior chamber 130. As shown in FIG. 1, overmolding the outsole 104 onto the lobes 152*a*-152*e* of the bladder 106 provides the outsole 104 and the sole structure 100 with a series of compressible contact points along the ground-engaging surface 30.

The upper 200 is attached to the sole structure 100 and includes interior surfaces that define an interior void 202 configured to receive and secure a foot for support on sole structure 100. The upper 200 may be formed from one or more materials that are stitched or adhesively bonded together to form the interior void 202. Suitable materials of the upper may include, but are not limited to, mesh, textiles, foam, leather, and synthetic leather. The materials may be selected and located to impart properties of durability, air-permeability, wear-resistance, flexibility, and comfort.

Figure 9:
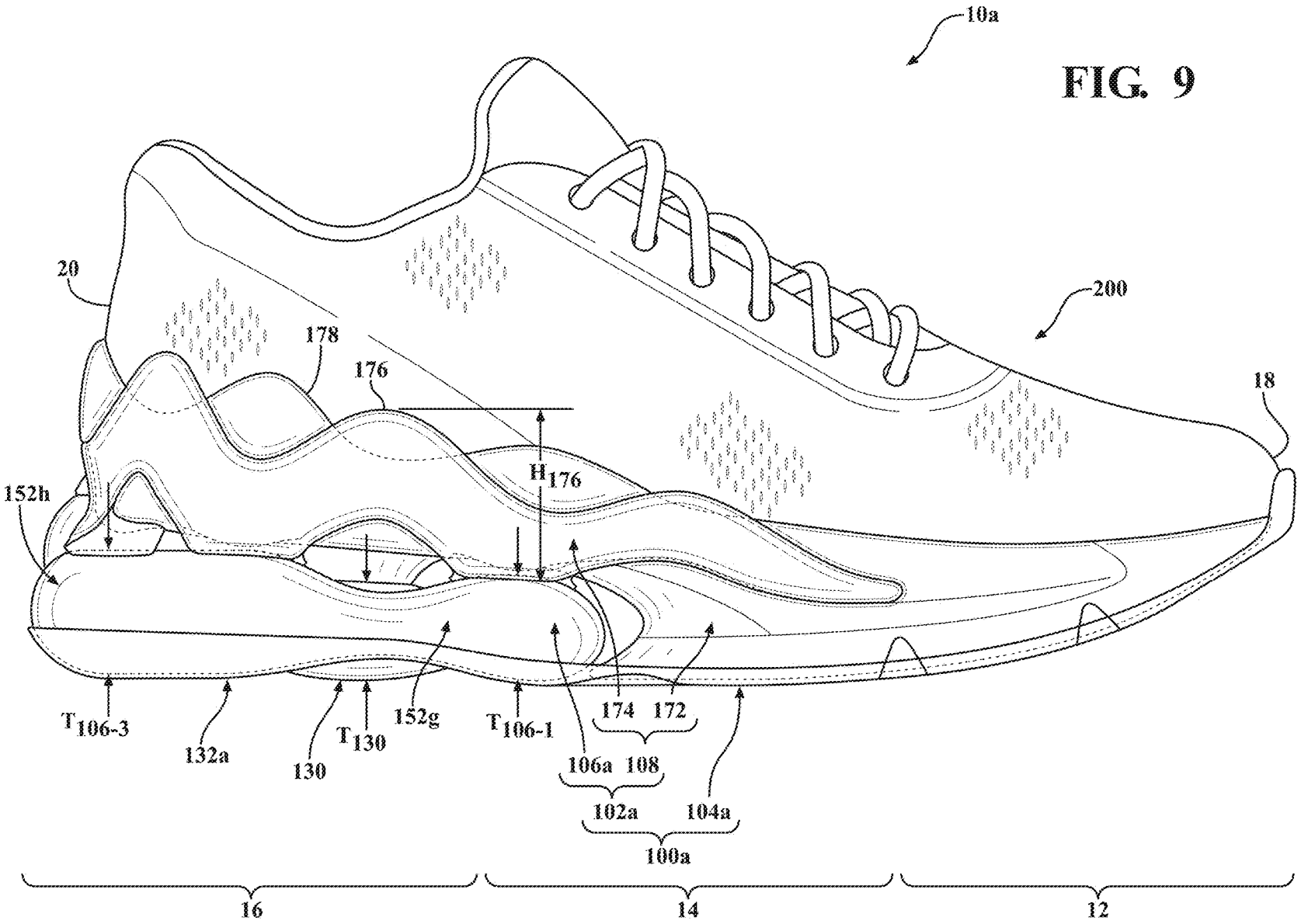
FIG. 9 is a side perspective view of an article of footwear in accordance with principles of the present disclosure.
Figure 10A:
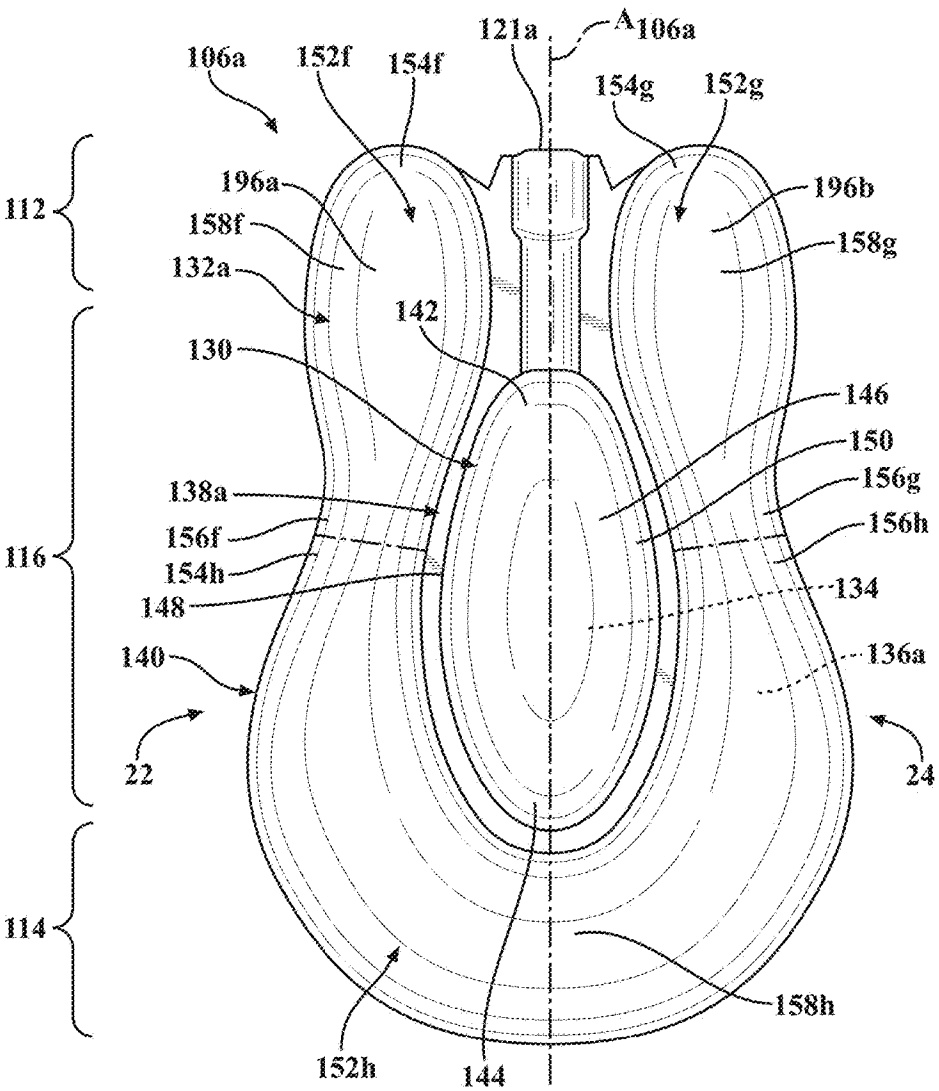
FIGS. 10A and 10B are bottom plan views of a bladder of the article of footwear of FIG. 9.
Figure 10B:
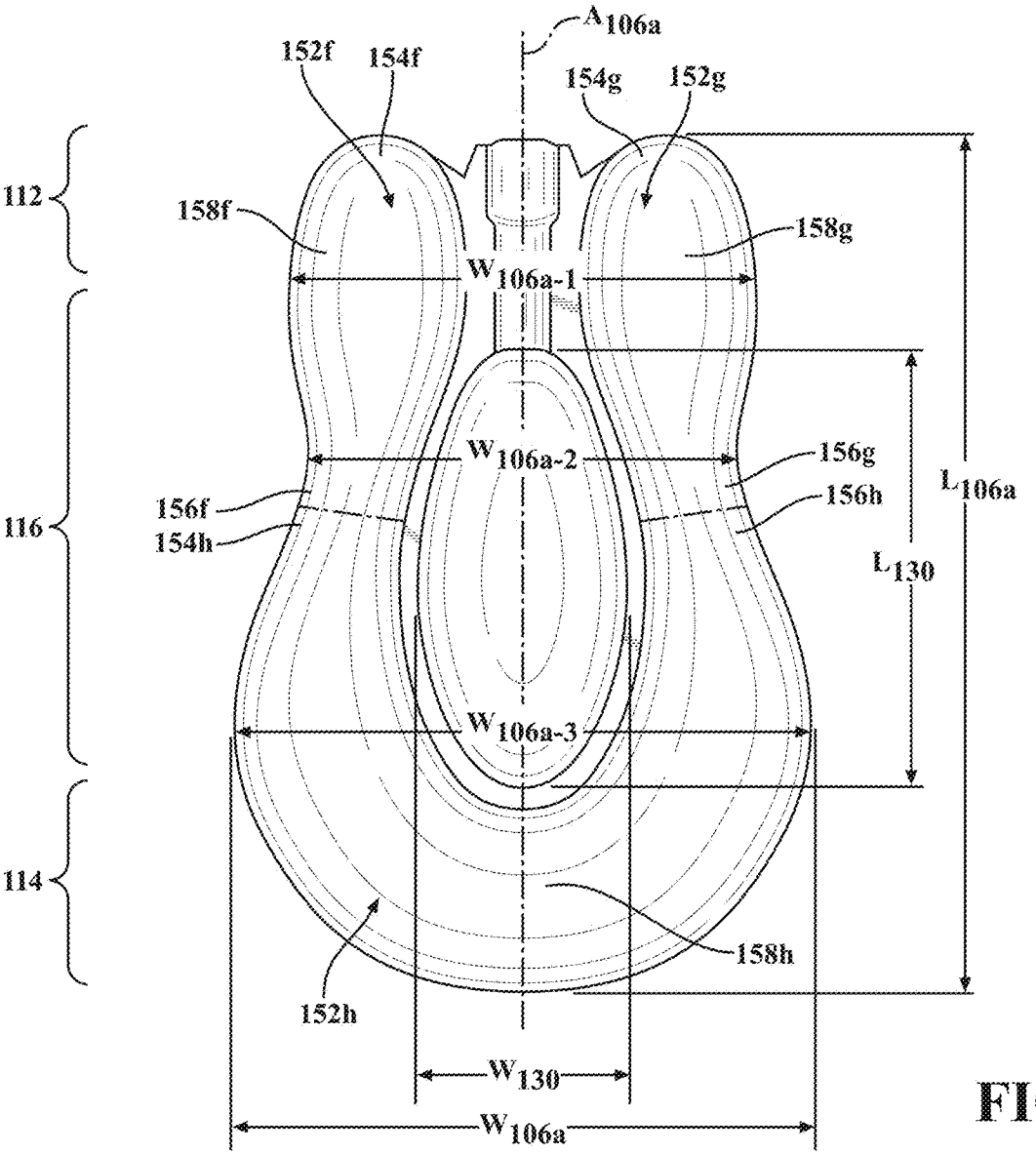

With particular reference to FIGS. 9 and 10B, an article of footwear 10*a* is provided and includes a sole structure 100*a* and the upper 200 attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

In the illustrated example, the sole structure 100*a* includes a midsole 102*a* and an outsole 104*a* having similar characteristics and configurations as the midsole 102 and the outsole 104 described above. However, the midsole 102*a* of this example includes a bladder 106*a* having the interior chamber 130 and a peripheral chamber 132*a* that only partially surrounds the interior chamber 130. For example, as shown in FIG. 10, the peripheral chamber 132*a* includes a first terminal end 196*a* and a second terminal end 196*b* disposed at the anterior end 112 of the bladder 106*a*. As shown, the peripheral chamber 132*a* extends along the lateral side 148 of the interior chamber 130 from the first terminal end 196*a*, around the posterior end 144 of the interior chamber 130 at the posterior end 114 of the bladder 106, and along the medial side 150 of the interior chamber 130 to the second terminal end 196*b*. Accordingly, the peripheral chamber 132*a* of the bladder 106*a* may be described as being a U-shaped or horseshoe-shaped structure.

With continued reference to FIG. 10, the terminal ends 196*a*, 196*b* of the peripheral chamber 132*a* are spaced apart from each other along the lateral direction at the anterior end 112. Here, the web area 138*a* may extend between and connect the terminal ends 196*a*, 196*b* at the anterior end 112. Optionally, the web area 138*a* may include a valve 121*a* that provides fluid communication with the interior chamber 130 and the peripheral chamber 132*a* during a manufacturing process of the bladder 106*a*.

As discussed above with respect to the bladder 106, the peripheral chamber 132*a* of the bladder 106*a* includes one or more of the lobes 152*f*-152*h*. In the illustrated example, the peripheral chamber 132*a* includes a lateral anterior lobe 152*f* disposed at the first terminal end 196*a* on the lateral side 22 of the bladder 106*a*, and a medial anterior lobe 152*g* disposed at the second terminal end 196*b* on the medial side 24 of the bladder 106*a*. The peripheral chamber 132*a* further includes a posterior lobe 152*h* disposed at the posterior end 114 of the bladder 106*a*. In this example, the posterior lobe 152*h* may extend from a first end 154*h* that is connected to a second end 156*f* of the lateral anterior lobe 152*f* in the intermediate region 116 of the bladder 106*a*, to a second end 156*g* that is connected to a second end 156*g* of the medial anterior lobe 152*g* in the intermediate region 116 of the bladder 106*a*.

As shown in FIG. 10B, the variable cross section of the peripheral chamber 132*a* results in the overall width $W_{106a}$ of the bladder 106*a* being variable from the anterior end 112 to the posterior end 114. Particularly, the bladder 106*a* has a first width $W_{106a\text{-}1}$ across the intermediate portions 158*f*, 158*g* of the anterior lobes 152*f*, 152*g* adjacent to the anterior end 112, a second width $W_{106a\text{-}2}$ across the second ends 156*f*, 156*g* of the anterior lobes 152*f*, 152*g* in the intermediate region 116, and a third width $W_{106a\text{-}3}$ across the posterior lobe 152*h* at the first and second ends 154*h*, 156*h*. Here, the second width $W_{106a\text{-}2}$ is W less than the first width $W_{106a\text{-}1}$ and the third width $W_{106a\text{-}3}$, while the third width $W_{106a\text{-}3}$ is greater than the first width $W_{106a\text{-}1}$ and the second width $W_{106a\text{-}2}$.

In the illustrated example, the interior void 134 of the interior chamber 130 includes a first fluid at a first pressure and the interior void 136*a* of the peripheral chamber 132*a* includes a second fluid at a second pressure. As discussed above, the interior chamber 130 is isolated from the peripheral chamber 132 such that the first pressure and the second pressure may be independently maintained within the interior voids 134, 136*a*. The first pressure and the second pressure may be different from each other. For instance, the first pressure within the interior void 134 of the interior chamber 130 may be less than the second pressure within the interior void 136*a* of the peripheral chamber 132*a* when the bladder 106 is in an uncompressed (i.e., natural) state. In some examples, the first pressure ranges from 0 psi to 20 psi, and more particularly from 5 psi to 15 psi, and even more particularly from 7 psi to 10 psi. The second pressure may range from 0 psi to 35 psi, and more particularly from 15 psi to 30 psi, and even more particularly from 20 psi to 25 psi.

Figure 11:
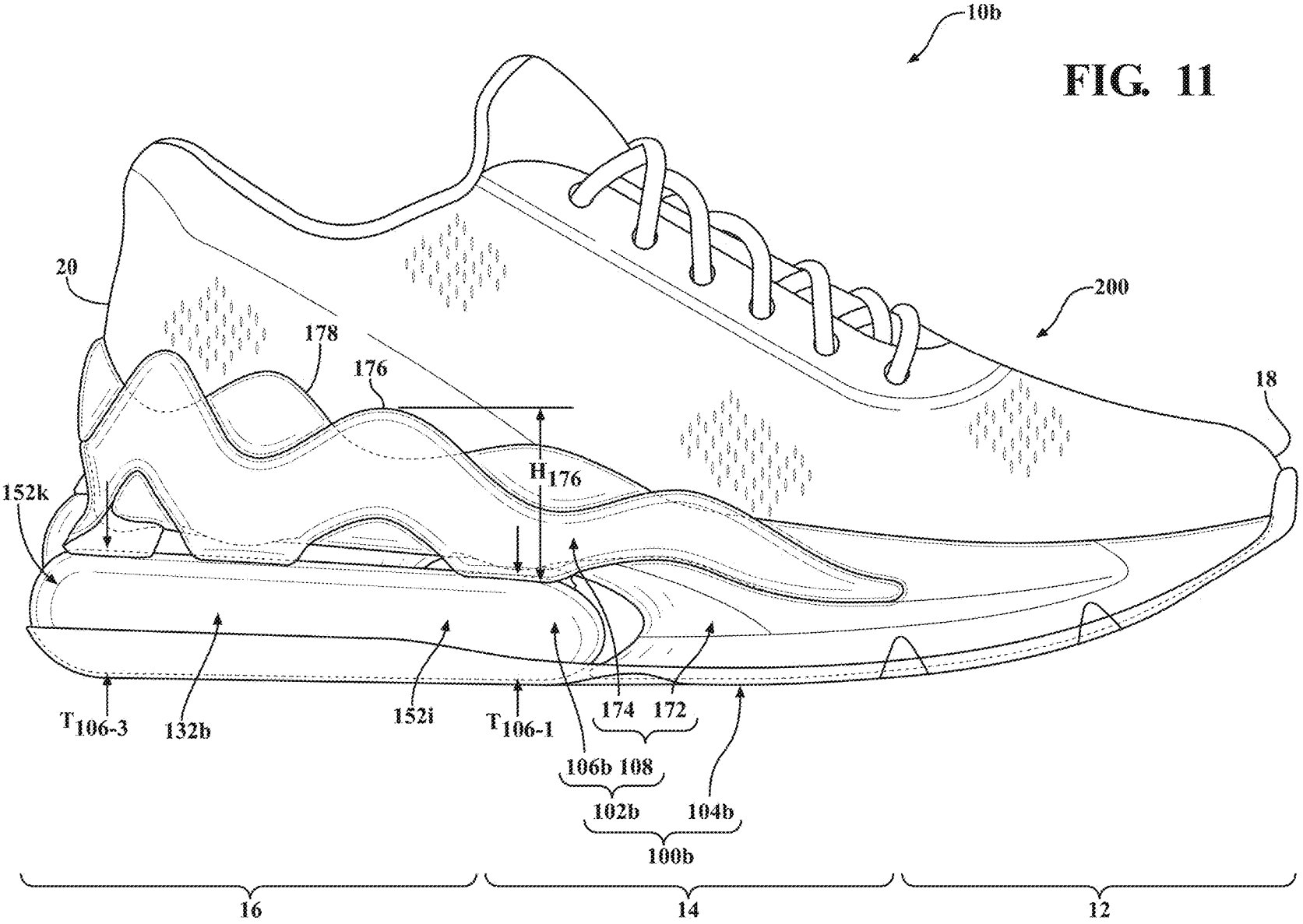
FIG. 11 is a side perspective view of an article of footwear in accordance with principles of the present disclosure.
Figure 12A:
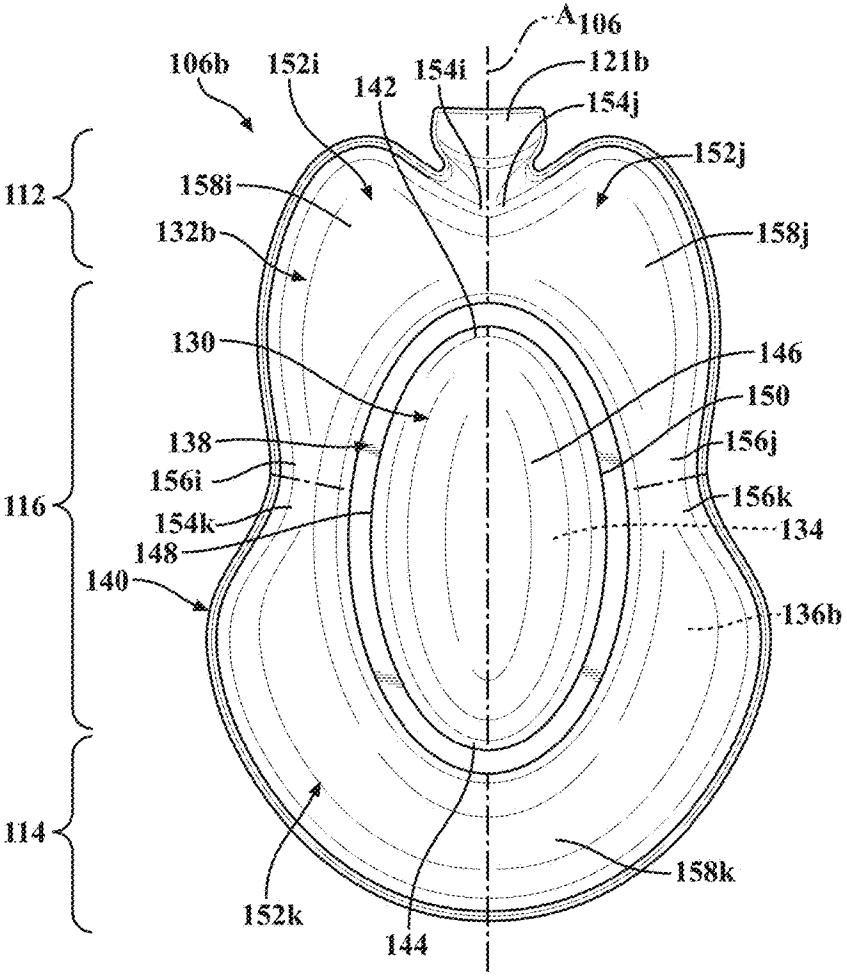
FIGS. 12A and 12B are bottom plan views of a bladder of the article of footwear of FIG. 11.

With particular reference to FIGS. 11 and 12, an article of footwear 10*b* is provided and includes a sole structure 100*b* and the upper 200 attached to the sole structure 100*b*. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

In the illustrated example, the sole structure 100*b* includes a midsole 102*b* and an outsole 104*b* having similar characteristics and configurations as the midsoles 102, 102*a* and the outsoles 104, 104*a* described above. Here, the bladder 106*b* is formed with the interior chamber 130 and a peripheral chamber 132*b*, where the peripheral chamber 132*b* is interminable and includes an elongate posterior lobe 152*k* extending around the posterior end 114 of the bladder 106*b*. Optionally, the peripheral chamber 132*b* may include a valve 121*a* that provides fluid communication with the interior chamber 130 and the peripheral chamber 132*b* during a manufacturing process of the bladder 106*a*.

As shown, the peripheral chamber 132*b* of the bladder 106*b* includes a series of the lobes 152*i*-152*k* including a lateral anterior lobe 152*i* disposed at the anterior end 112 on the lateral side 22, and a medial anterior lobe 152*j* disposed at the anterior end 112 on the medial side 24. Here, the first ends 154*i*, 154*j* of the anterior lobes 152*i*, 152*j* are connected to each other along the longitudinal axis $A_{106b}$ of the bladder 106*b* and the second ends 156*i*, 156*j* of the anterior lobes 152 extend into the intermediate region 116 on the lateral and medial sides 148, 150 of the interior chamber 130.

The posterior lobe 152*k* extends from a first end 154*k* connected to the second end 156*i* of the lateral anterior lobe 152*i* in the intermediate region 116 on the lateral side 22, to a second end 156*k* connected to the second end 156*j* of the medial anterior lobe 152*j* in the intermediate region on the medial side 24. Thus, the posterior lobe 152*k* extends continuously around the posterior end 114 from the lateral side 22 of the bladder 106*b* to the medial side 24 of the bladder 106*b*. In the illustrated example, the intermediate portion 158*k* of the posterior lobe may include a substantially constant cross-sectional area from the first end 154*k* to the second end 156*k*.

Figure 12B:
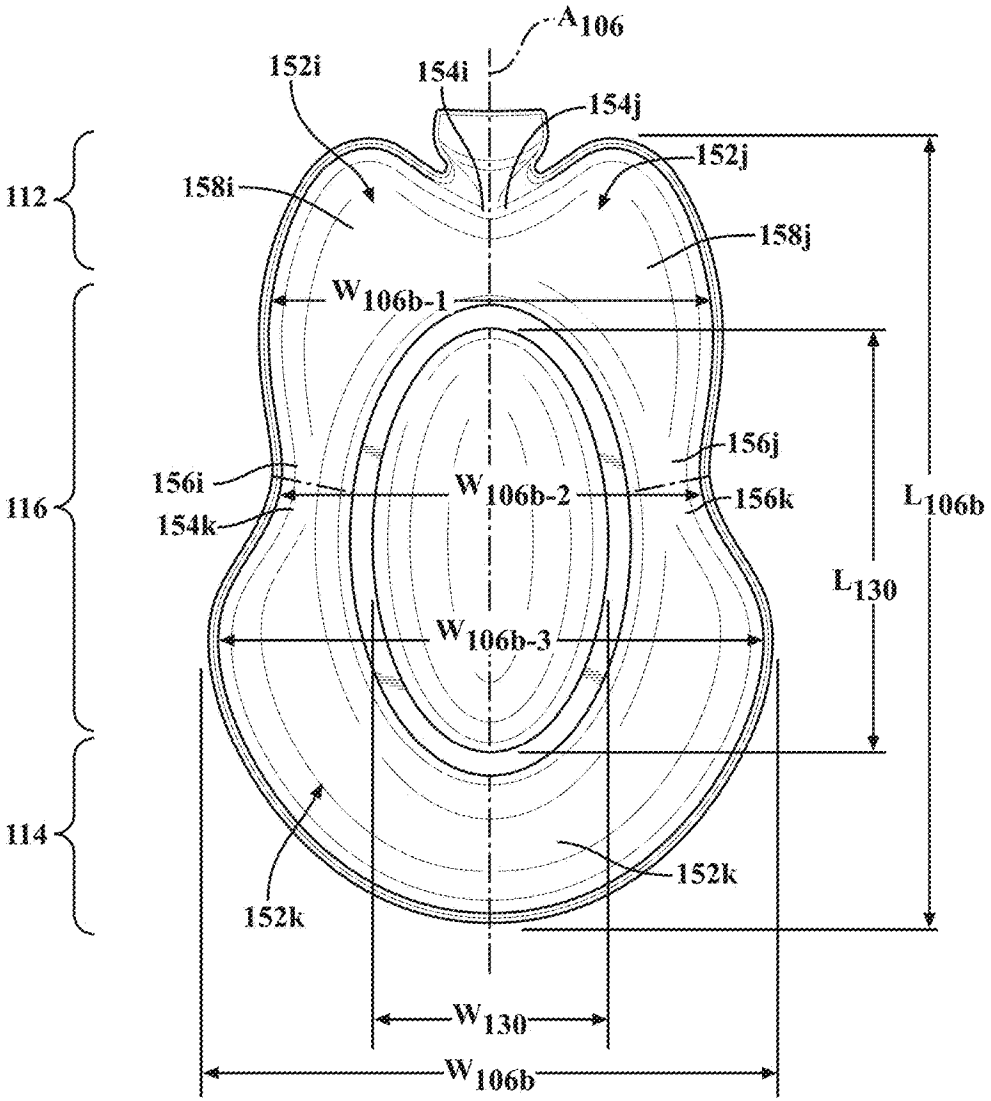

As shown in FIG. 12B, the variable cross section of the peripheral chamber 132*b* results in the overall width $W_{106b}$ of the bladder 106*b* being variable from the anterior end 112 to the posterior end 114. Particularly, the bladder 106*b* has a first width $W_{106b\text{-}1}$ across the intermediate portions 158*i*, 158*j* of the anterior lobes 152*i*, 152*j* adjacent to the anterior end 112, a second width $W_{106b\text{-}2}$ across the second ends 156*i*, 156*j* of the anterior lobes 152*i*, 152*j* in the intermediate region 116, and a third width $W_{106b\text{-}3}$ across the intermediate portion 158*k* of the posterior lobe 152*k* adjacent to the first and second ends 154*k*, 156*k*. Here, the second width $W_{106b\text{-}2}$ is less than the first width $W_{106b\text{-}1}$ and the third width $W_{106b\text{-}3}$, while the third width $W_{106b\text{-}3}$ is greater than the first width $W_{106b\text{-}1}$ and the second width $W_{106b\text{-}2}$.

In the illustrated example, the interior void 134 of the interior chamber 130 includes a first fluid at a first pressure and the interior void 136*b* of the peripheral chamber 132*b* includes a second fluid at a second pressure. As discussed above, the interior chamber 130 is isolated from the peripheral chamber 132*b* such that the first pressure and the second pressure may be independently maintained within the interior voids 134, 136*b*. The first pressure and the second pressure may be different from each other. For instance, the first pressure within the interior void 134 of the interior chamber 130 may be less than the second pressure within the interior void 136*b* of the peripheral chamber 132*b* when the bladder 106*b* is in an uncompressed (i.e., natural) state. In some examples, the first pressure ranges from 0 psi to 20 psi, and more particularly from 5 psi to 15 psi, and even more particularly from 7 psi to 10 psi. The second pressure may range from 0 psi to 35 psi, and more particularly from 15 psi to 30 psi, and even more particularly from 20 psi to 25 psi.

The following Clauses provide exemplary configurations for an article of footwear, a bladder for an article of footwear, or a sole structure for an article of footwear described above.

Clause 1: A bladder for an article of footwear, the bladder extending from an anterior end to a posterior end and comprising: a first chamber disposed in an interior region of the bladder and including a first interior void having a first pressure; and a second chamber at least partially surrounding the first chamber and including a second interior void having a second pressure.

Clause 2: The bladder of Clause 1, wherein the bladder has a first width adjacent to the anterior end of the bladder, a second width adjacent to the posterior end of the bladder, and a third width in an intermediate portion that is less than the first width and the second width.

Clause 3: The bladder of Clause 1, wherein the first chamber is an ovoid.

Clause 4: The bladder of Clause 1, wherein the second chamber includes an anterior portion having a first cross-sectional area, a posterior portion having a second cross-sectional area, and an intermediate portion connecting the anterior portion and the posterior portion and having a third cross-sectional area.

Clause 5: The bladder of Clause 4, wherein the third cross-sectional area is less than the first cross-sectional area.

Clause 6: The bladder of Clause 4, wherein the third cross-sectional area is less than the second cross-sectional area.

Clause 7: The bladder of Clause 4, wherein the third cross-sectional area is less than the first cross-sectional area and the second cross-sectional area.

Clause 8: The bladder of Clause 1, wherein the bladder includes a web area disposed between and connecting the first chamber and the second chamber.

Clause 9: The bladder of Clause 1, wherein the bladder includes a first barrier layer and a second barrier layer joined together at discrete locations to define the first chamber and the second chamber.

Clause 10: The bladder of Clause 9, wherein at least one of the first barrier layer and the second barrier layer is transparent.

Clause 11: The bladder of Clause 9, wherein at least one of the first barrier layer and the second barrier layer is translucent.

Clause 12: The bladder of Clause 1, wherein the second chamber completely surrounds the first chamber.

Clause 13: The bladder of Clause 1, wherein the second chamber partially surrounds the first chamber.

Clause 14: The bladder of Clause 1, wherein the second chamber includes a plurality of lobes, each lobe having a first end, a second end, and an intermediate portion disposed between the first end and the second end and being larger than the first end and the second end.

Clause 15: The bladder of Clause 14, wherein each lobe tapers from the intermediate portion to the first end and the second end.

Clause 16: The bladder of Clause 14, wherein, for each lobe, a thickness of the intermediate portion is greater than thicknesses of the first end and the second end.

Clause 17: The bladder of Clause 14, wherein, for each lobe, a width of the intermediate portion is greater than widths of the first end and the second end.

Clause 18: The bladder of Clause 14, wherein, for each lobe, a cross-sectional area of the intermediate portion is greater than the cross-sectional areas of the first end and the second end.

Clause 19: The bladder of Clause 14, wherein the plurality of the lobes are arranged in series around the first chamber.

Clause 20: The bladder of Clause 14, wherein the plurality of lobes includes a medial anterior lobe and a lateral anterior lobe.

Clause 21: The bladder of Clause 20, wherein the medial anterior lobe and the lateral anterior lobe are in direct fluid communication with each other.

Clause 22: The bladder of Clause 14, wherein the plurality of lobes includes a posterior lobe disposed at the posterior end of the bladder.

Clause 23: The bladder of Clause 22, wherein the posterior lobe extends from a first end on a medial side of the bladder to a second end on a lateral side of the bladder.

Clause 24: The bladder of Clause 22, wherein the plurality of lobes includes a lateral intermediate lobe and a medial intermediate lobe in direct fluid communication with the posterior lobe.

Clause 25: The bladder of Clause 24, wherein the lateral intermediate lobe and the medial intermediate lobe are smaller than the posterior lobe.

Clause 26: The bladder of Clause 24, wherein a cross-sectional area of an interior void of the second chamber is greater at the intermediate portion of the posterior lobe than at the intermediate portions of each of the lateral intermediate lobe and the medial intermediate lobe.

Clause 27: The bladder of Clause 22, wherein a thickness of the intermediate portion of the posterior lobe defines a maximum thickness of the bladder.

Clause 28: The bladder of Clause 14, wherein the plurality of lobes includes a lateral intermediate lobe and a medial intermediate lobe disposed between the anterior end and the posterior end of the bladder.

Clause 29: The bladder of Clause 1, wherein the first pressure is different than the second pressure.

Clause 30: The bladder of Clause 1, wherein the second pressure is greater than the first pressure.

Clause 31: The bladder of Clause 1, wherein the first pressure ranges from 0 psi to 20 psi.

Clause 32: The bladder of Clause 1, wherein the first pressure ranges from 5 psi to 15 psi.

Clause 33: The bladder of Clause 1, wherein the first pressure ranges from 7 psi to 10 psi.

Clause 34: The bladder of Clause 1, wherein the second pressure ranges from 0 psi to 35 psi.

Clause 35: The bladder of Clause 1, wherein the second pressure ranges from 15 psi to 30 psi.

Clause 36: The bladder of Clause 1, wherein the second pressure ranges from 20 psi to 25 psi.

Clause 37: The bladder of Clause 1, wherein the first pressure and the second pressure are atmospheric pressure.

Clause 38: The bladder of Clause 1, wherein a first thickness of the first chamber is greater than a second thickness of the second chamber at the anterior end and less than a third thickness of the second chamber at the posterior end.

Clause 39: A sole structure including the bladder of any of the preceding clauses.

Clause 40: An article of footwear including the bladder of any of Clause 1-37.

Clause 41: A sole structure for an article of footwear, the sole structure comprising: a chassis including a bottom surface forming a first portion of the chassis and a recessed surface offset from the bottom surface to define a recess in a second portion of the chassis; and a bladder disposed within the recess of the chassis and including a first chamber disposed in an interior region of the recess and a second chamber disposed in a peripheral region of the recess, the second chamber at least partially surrounding the first chamber and being fluidly isolated from the first chamber.

Clause 42: The sole structure of Clause 41, wherein the second chamber completely surrounds the first chamber.

Clause 43: The sole structure of Clause 41, wherein the second chamber partially surrounds the first chamber.

Clause 44: The sole structure of Clause 41, wherein the first chamber has a different pressure than the second chamber.

Clause 45: The sole structure of Clause 41, wherein the chassis includes a cushioning element forming the bottom surface and the interior region of the recesses surface, and a cradle at least partially defining the peripheral region of the recessed surface, the cradle being formed of a different material than the cushioning element.

Clause 46: The sole structure of Clause 41, wherein the recessed surface includes a plurality of supports each configured to interface with a respective lobe of the bladder.

Clause 47: The sole structure of Clause 46, wherein a first one of the supports is formed of a first material and a second one of the supports is formed of a second material that is different than the first material.

Clause 48: The sole structure of Clause 46, wherein the plurality of supports includes an interior support interfacing with the first chamber and a plurality of peripheral supports each interfacing with a respective lobe of the second chamber.

Clause 49: The sole structure of Clause 41, further comprising an outsole having a first portion attached to the chassis and a second portion attached to the bladder.

Clause 50: The sole structure of Clause 49, wherein the second portion of the outsole includes an interior portion attached to the first chamber and a peripheral portion attached to the second chamber and independently movable relative to the interior portion.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising: a midsole extending continuously from an anterior end of the sole structure to a posterior end of the sole structure and including an interior support extending in a direction toward the ground-engaging surface and in contact with the bladder; a bladder having an upper barrier layer joined to a lower barrier layer, the bladder disposed closer to a ground-engaging surface of the sole structure than the midsole and including a first chamber having a series of lobes extending around a perimeter of the first chamber; and a cradle including a wall in contact with the midsole and a plurality of supports extending from the wall in a direction toward the ground-engaging surface, supports of the plurality of supports including lower surfaces in contact with respective lobes of the bladder at an uppermost surface of the upper barrier layer and defining recesses between adjacent supports of the plurality of supports where the cradle is spaced apart from the uppermost surface of the upper barrier layer.

2. The sole structure of claim 1, wherein the wall extends from a medial side of the sole structure, around a heel region of the sole structure, to a lateral side of the sole structure.

3. The sole structure of claim 1, wherein a height of the wall varies along a length of the wall.

4. The sole structure of claim 1, wherein the bladder includes a second chamber at least partially surrounded by the first chamber.

5. The sole structure of claim 4, wherein the second chamber is an ovoid.

6. The sole structure of claim 4, wherein a pressure of the second chamber is different than a pressure of the first chamber.

7. The sole structure of claim 4, wherein a pressure of the second chamber is less than a pressure of the first chamber.

8. The sole structure of claim 4, wherein the interior support is in contact with the second chamber.

9. An article of footwear incorporating the sole structure of claim 1.

10. A sole structure for an article of footwear, the sole structure comprising:

a midsole extending continuously from an anterior end of the sole structure to a posterior end of the sole structure and including an interior support;

a bladder having an upper barrier layer joined to a lower barrier layer, the bladder disposed closer to a ground-engaging surface of the sole structure than the midsole and including a first chamber and a second chamber at least partially surrounded by the first chamber, the second chamber in contact with the interior support; and a cradle including a wall in contact with the midsole and a plurality of supports extending from the wall in a direction toward the ground-engaging surface, supports of the plurality of supports in contact with the first chamber of the bladder at an uppermost surface of the upper barrier layer and defining recesses between adjacent supports of the plurality of supports where the cradle is spaced apart from the uppermost surface of the upper barrier layer.

11. The sole structure of claim 10, wherein the wall extends from a medial side of the sole structure, around a heel region of the sole structure, to a lateral side of the sole structure.

12. The sole structure of claim 10, wherein a height of the wall varies along a length of the wall.

13. The sole structure of claim 10, wherein the first chamber is separated from the second chamber by a web area.

14. The sole structure of claim 10, wherein the second chamber is an ovoid.

15. The sole structure of claim 10, wherein a pressure of the second chamber is different than a pressure of the first chamber.

16. The sole structure of claim 10, wherein a pressure of the second chamber is less than a pressure of the first chamber.

17. The sole structure of claim 10, wherein the interior support is disposed in a heel region of the sole structure.

18. The sole structure of claim 10, wherein the cradle extends from a heel region of the sole structure and into a forefoot region of the sole structure.

19. An article of footwear incorporating the sole structure of claim 10.

* * * * *